United States Patent [19]

Härle

[11] Patent Number: 4,629,331

[45] Date of Patent: Dec. 16, 1986

[54] WINDABLE CLOCKWORK FOR A METRONOME

[75] Inventor: Fritz Härle, Isny, Fed. Rep. of Germany

[73] Assignee: Rudolph Wittner GmbH & Co., Isny, Fed. Rep. of Germany

[21] Appl. No.: 786,055

[22] Filed: Oct. 10, 1985

[30] Foreign Application Priority Data

Nov. 3, 1984 [DE] Fed. Rep. of Germany ..... 3440264

[51] Int. Cl.[4] ..... G04B 5/00

[52] U.S. Cl. ..... 368/147; 368/140

[58] Field of Search ..... 368/140, 147

[56] References Cited

U.S. PATENT DOCUMENTS 756,703 4/1904 Porter ..... 368/147

FOREIGN PATENT DOCUMENTS 480742 8/1929 Fed. Rep. of Germany ..... 368/147

1075804 10/1954 France ..... 368/147

306104 5/1955 Switzerland ..... 368/147

*Primary Examiner*—Bernard Roskoski

*Attorney, Agent, or Firm*—Laubscher & Laubscher

[57] ABSTRACT

A windable clockwork for metronomes comprises a clockwork frame, a stem rotatably mounted in this frame, a spiral spring connected to this stem, a housing enclosing the spring, and a blocking mechanism which prevents the stem and the spring from reverse motion during the winding. The blocking mechanism comprises two coaxially arranged parts made from a plastic material, namely a locking disc and a spring disc. One of these parts is stationarily arranged on the frame and the other is connected to the stem. The locking disc comprises at its periphery at least one integrally formed stop and the spring disc carries at least one likewise intergrally formed, resilient tongue which in one rotational direction of the stem glides elastically past the stop, but in the opposite rotational direction abuts the stop and blocks the reverse motion of the stem and the spring.

3 Claims, 5 Drawing Figures

WINDABLE CLOCKWORK FOR A METRONOME

BACKGROUND OF THE INVENTION

The invention relates to a windable clockwork for a metronome with a clockwork frame, a stem rotatably mounted in the frame, a spiral spring connected to the stem, a housing enclosing the spring and with a blocking mechanism which prevents the stem and the spring from reverse motion during the winding.

BRIEF DESCRIPTION OF THE PRIOR ART

In known clockworks of this kind, the blocking mechanism comprises a helical spring attached at one side to the frame, which surrounds and rubs on the stem so as to prevent the stem from undesired reverse rotational motion by frictional engagement. Such blocking mechanisms with a helical spring are expensive to manufacture, require substantial assembly expenditure and have only a limited working life. The known blocking mechanisms are, in particular, unsuitable for automatic installation in the metronome clockwork and also permit an undesired block-type winding-up of the clockwork spring, during which the individual spiral spring windings are in an abutting position.

SUMMARY OF THE INVENTION

The object underlying the invention is to remedy the above-described deficiencies and to propose a generic clockwork whose blocking mechanism is simple to manufacture and easily—more particularly, automatically—assembled, and, in particular, protects the spiral spring from a block-type winding-up.

The object is attained in accordance with the invention in that the blocking mechanism comprises two coaxially arranged parts made from a synthetic plastics material, namely a locking disc and a spring disc, in that one of these parts is stationarily arranged on the frame and the other is connected to the stem, in that the locking disc comprises at its periphery at least one integrally formed stop, and in that the spring disc carries at least one likewise integrally formed, resilient tongue which in one rotational direction of the stem glides elastically past the stop, but in the opposite rotational direction abuts the stop and blocks the reverse motion of the stem and the spring.

BRIEF DESCRIPTION OF THE FIGURES

The following description of a preferred embodiment serves in conjunction with the appended drawings to explain the invention in greater detail.

DETAILED DESCRIPTION

Figure 1:
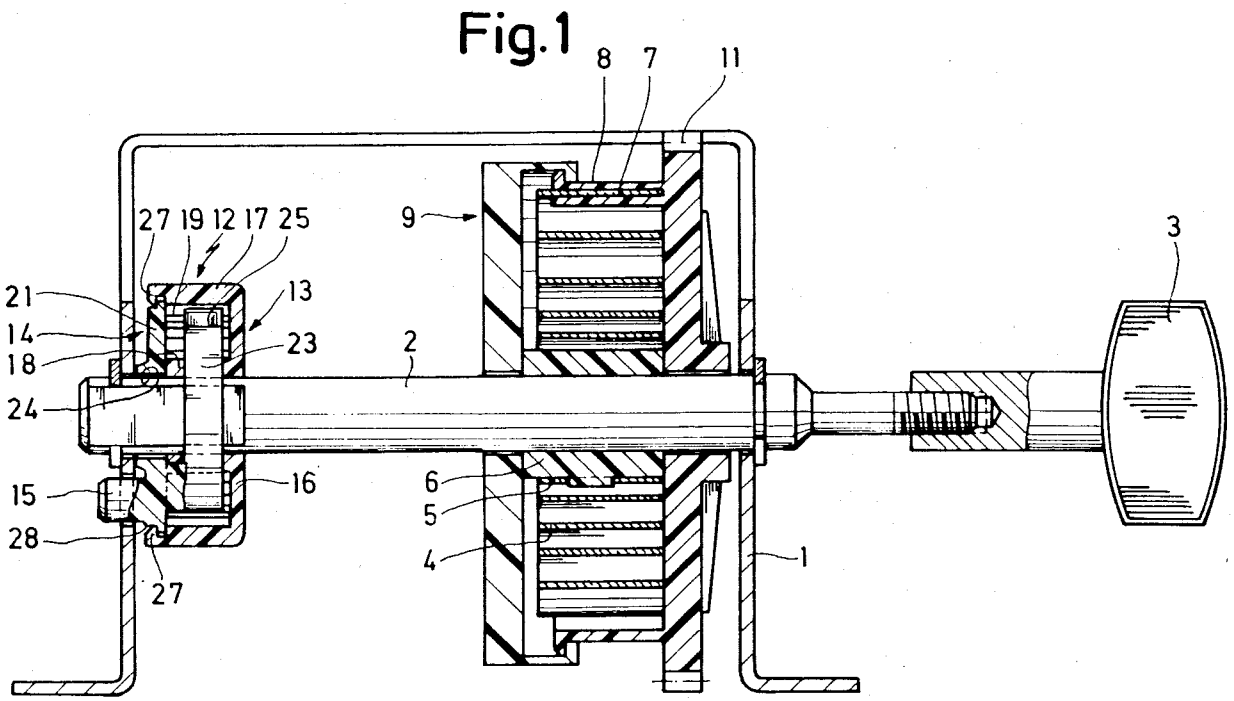
FIG. 1 is a sectional view of a (half-finished) metronome clockwork with a blocking mechanism.

FIG. 1 shows a half-finished, windable clockwork for a metronome comprising a clockwork frame 1, in which a stem 2 with a knob 3 is rotatably mounted. A spiral spring 4 arranged coaxially with the stem 2 is rigidly connected at its internally located end 5 via a hub 6 to the stem 2. The externally located end 7 is fixed at the inside wall 8 of a two-piece housing 9 which carries an external toothing 11 and is rotatable on the stem 2. The external toothing 11 meshes (in a conventional manner which is not illustrated) with further gears of the clockwork which are driven by the spring 4 and the external toothing 11.

When the clockwork is wound, the stem 2 is rotated via the knob 3 (when the housing 9 is in a stationary position), whereby the spiral spring 4 is tensioned and stores driving force for the clockwork. When the spring tension is released, the housing 9 rotates (with the stem 2 in a stationary position) in the direction opposite to the winding direction and drives the clockwork via the external toothing 11 in a manner known per se.

A blocking mechanism 12 is provided to prevent reverse motion of the stem 2 and thus the spring 4 during winding of the clockwork, i.e., when the stem 2 is rotated. This blocking mechanism permits rotation of the stem 2 in the winding direction, but prevents rotation of the stem in the opposite direction, so that, in particular, during the running of the clockwork, the stem is motionless and acts as axis for the housing 9.

The blocking mechanism 12 comprises two parts 13, 14, whose design will be described in detail. The part 13 in the form of a locking disc is rotatably connected to the stem 2, the part 14 in the form of a spring disc is fixed by a pin 15 in a non-rotatable manner on the frame 1. When the stem 2 is rotated, the part 13 rotates relative to the stationary part 14. Reverse motion of the stem 2 is prevented by a special design of the parts 13, 14 as locking and spring discs, respectively, which will be described hereinafter.

Figure 2:
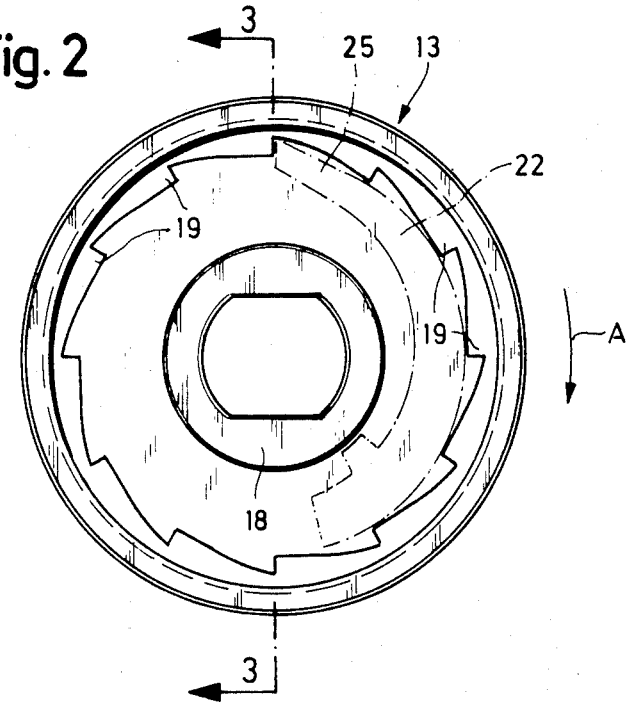
FIG. 2 is a view of a locking disc.
Figure 3:
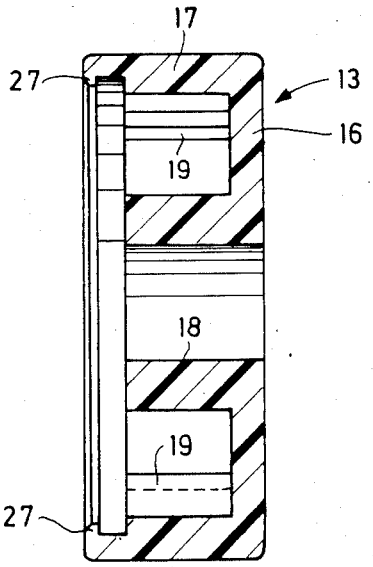
FIG. 3 is a sectional view of the locking disc taken along the line 3—3 in FIG. 2.

FIGS. 2 and 3 show top and sectional views of the part 13 acting as locking disc. The locking disc 13 is in the form of a dish-type housing with a bottom 16 and an outside peripheral wall 17. The locking disc 13 is rotatably positioned on the correspondingly flattened stem 2 by means of a central boss 18, whose internal cross-sectional shape apparent from FIG. 2 is non-circular. The self-contained peripheral wall 17 of the locking disc 13 extending coaxially with the boss 18 comprises on its inside inwardly directed teeth 19 acting as stops.

Figure 4:
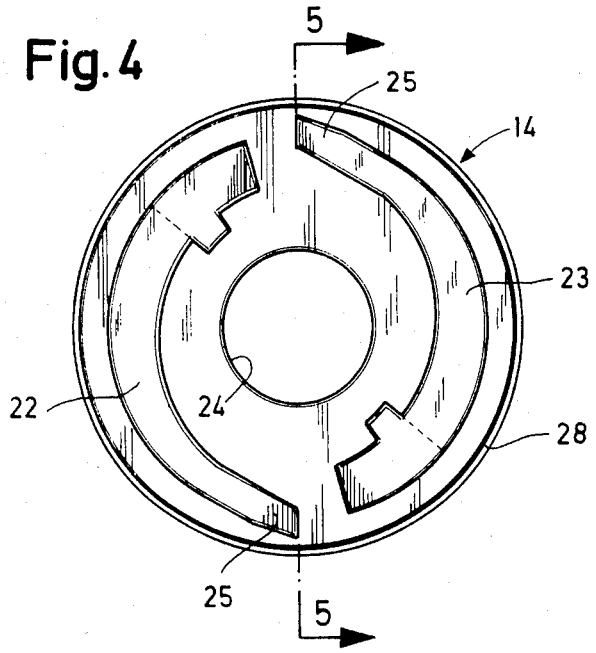
FIG. 4 is a view of a spring disc.
Figure 5:
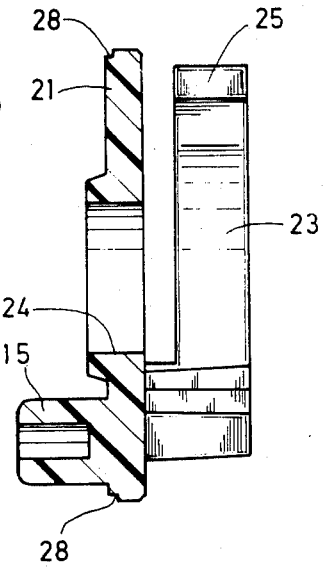
FIG. 5 is a sectional view of the spring disc taken along the line 5—5 in FIG. 4.

The spring disc 14 illustrated in top and sectional views in FIGS. 4 and 5, respectively, is inserted coaxially into the housing-type locking disc 13. Protruding in a cantilever manner from a disc-type bottom 21 of the spring disc 14 which also carries the detaining pin 15 mentioned in connection with FIG. 1, are two spring tongues 22, 23 which are radially elastically resilient at their front, free end. The stem 2 can rotate freely in a corresponding recess 24 of the bottom 21 while the clockwork is being wound.

As is apparent from the dot-and-dash illustration in FIG. 2, the free end of each of the springs 22 rests against the internal toothing of the locking disc 13 formed by the teeth 19. When the locking disc 13 rigidly connected to the stem 2 is rotated in the winding direction, i.e., in the direction of the arrow A in FIG. 2, the free ends 25 of the spring tongues 22, 23 glide freely over the teeth. Rotation of the locking disc 13 in the direction opposite to the direction of the arrow A, i.e., in the reverse direction of the stem 2 and the spiral spring 4, is, however, prevented by the free ends 25 of the spring tongues 22, 23 then snapping in behind the corresponding flanks of the teeth 19 and blocking this reverse motion.

The locking and spring discs 13 and 14, respectively, are each integrally manufactured from a synthetic plastics material. In principle, one single tooth 19 on the locking disc 13 and one single spring tongue 22 on the spring disc 14 suffice as stop. In a preferred embodiment of the invention, however, several continuously adjoining teeth in accordance with FIG. 2, and two spring tongues 22, 23 in accordance with FIG. 4, are used.

In the illustrated embodiment, the locking disc 13 is rotatably connected to the stem 2, while the spring disc 14 is fixed to the frame 1 via the pin 15. The design could also be vice versa, with the locking disc 13 being arranged stationarily on the frame, and the spring disc 14 being rotatably connected to the stem 2.

The spring disc 14 and the locking disc 13 which covers the spring disc 14 in a housing-type manner, are rotatably connected to each other, via a detent means formed by an annular nose 27 at the free front end of the peripheral wall 17 and a corresponding step 28 on the spring disc 14 (FIGS. 1, 3 and 5). The step 28 may be snapped in behind the nose 27, whereby the two parts 13, 14 are rotatably connected to each other. The actual blocking mechanism, namely the spring tongues 22, 23 and the teeth 19 are thereby fully shielded from environmental influences.

As is apparent, in principle, from FIG. 2, the actual blocking or detent positions of the described blocking mechanism are only where the edge of the free end 25 of the spring tongues 22, 23 snap in immediately behind the corresponding flanks of the teeth 19. If the winding procedure is interrupted between these positions, i.e., between the flanks of the teeth 19, the blocking mechanism can turn back under the influence of the force emanating from the spiral spring 4 until the free end 25 of the spring tongue strikes the flank of the next tooth 19 facing it. This minimal reverse motion limited to a certain angular path is desired since a block-type winding-up of the spiral spring 4, i.e., a mutual abutment of the individual spring windings is thereby prevented. This desired reverse motion increases with an increase in the spacing between the aforementioned tooth flanks acting as stops for the spring tongues. This desired reverse motion may be suitably set by corresponding selection of the number and design of the teeth.

The main advantages of the invention are the following: since the two parts 13, 14 may be integrally formed from a synthetic plastics material, the blocking mechanism is easily and rapidly assembled, and automatic manufacture is also possible. If the blocking mechanism is made of suitable synthetic plastics material, it is practically resistant to wear and, consequently, has a substantially longer working life than known locking mechanisms with a helical spring subject to frictional wear. Again, in contrast to the known helical spring blocking mechanism, assembly is, furthermore, possible without a special tool. As previously explained, the spiral spring 4 may be relieved of a block-type winding-up by appropriate spacing of the toothing. The housing-type covering of the blocking mechanism prevents inexpert tampering. The elastic spring tongues 22, 23 may be kept in smooth working order since, in the event of load, they are supported with respect to radial pressure by the housing-type locking disc.

What is claimed is:

1. A windable clockwork for a metronome including a clockwork frame, a stem rotatably connected with the frame, a spiral spring connected with the stem, a housing enclosing the spring, and a blocking mechanism for preventing the stem and spring from reverse motion during winding of the clockwork, the blocking mechanism comprising (a) a pair of blocking members formed of synthetic plastic material, one of said blocking members including a boss for connecting said one member with the stem and the other of said blocking members including pin means for stationarily connecting said other member with the frame; and (b) interlocking detent means for rotatably connecting said blocking members in coaxial relation;

(c) said blocking members including (1) a locking disc, including (i) an integral peripheral wall housing portion; and (ii) at least two radially inwardly directed teeth defining stops in said peripheral wall portion; and (2) a spring disc arranged within said locking disc peripheral wall housing and including radially outwardly directed resilient tongue means arranged adjacent said locking disc teeth, said tongue means gliding past said stops during rotation of the stem in one direction and abutting one of said stops to arrest rotation of the stem in the opposite direction.

2. Apparatus as defined in claim 1, wherein said locking disc includes a self-contained internal toothed ring having more than two teeth formed therein.

3. Apparatus as defined in claim 2, wherein said tongue means comprises a pair of tongues curved in the peripheral direction and arranged in a cantilever manner.

* * * * *